US005393029A

United States Patent [19]

Senko

[11] Patent Number: 5,393,029

[45] Date of Patent: Feb. 28, 1995

[54] PORTABLE AND RETRACTABLE BOOK-READING STAND

[75] Inventor: Hajime Senko, Tokyo, Japan

[73] Assignee: Project Center Co., Ltd., Tokyo, Japan

[21] Appl. No.: 987,006

[22] Filed: Dec. 7, 1992

[30] Foreign Application Priority Data

Nov. 6, 1992 [JP] Japan ..... 4-083154

[51] Int. Cl.[6] ..... A47B 97/04

[52] U.S. Cl. ..... 248/447; 248/452; 248/460; 248/461

[58] Field of Search ..... 248/441.1, 447, 448, 248/452, 460, 461, 462, 421, 277

[56] References Cited

U.S. PATENT DOCUMENTS

| | | | |
|---|---|---|---|
| 1,412,168 | 4/1922 | Comingore | 248/448 |
| 2,140,674 | 12/1938 | Hassett | 248/460 X |
| 3,140,558 | 7/1964 | Cassidy | 248/448 X |
| 3,991,967 | 11/1967 | Sack | 248/448 |
| 4,323,214 | 4/1982 | DeLuca | 248/461 X |
| 4,369,948 | 1/1983 | Krauss et al. | 248/447 X |
| 4,483,505 | 11/1984 | Dalbo | 248/460 X |
| 4,722,504 | 2/1988 | Degenholtz | 248/460 X |
| 4,886,231 | 12/1989 | Doerksen | 248/460 X |

*Primary Examiner*—Ramon O. Ramirez
*Assistant Examiner*—Derek J. Berger
*Attorney, Agent, or Firm*—Lackenbach Siegel Marzullo Aronson & Greenspan

[57] ABSTRACT

This invention aims to provide a portable and retractable book-reading stand which is easily carried, does not require spacious installing space, and is providable at low cost.

This invention is characterized in having a case having a bottom plate and a covering body rotatably connected to the bottom plate which holds the bottom plate at a specified inclined angle by rotating the covering body, and a supporting assembly for holding a document which is expandable along the inclined bottom plate in expanded condition, and retractable up to the size being housed in the case in retracted position, and a clip installed on the upper portion of the supporting assembly.

9 Claims, 7 Drawing Sheets

PORTABLE AND RETRACTABLE BOOK-READING STAND

BACKGROUND OF THE INVENTION

This invention relates to a portable and retractable book-reading stand for holding books, documents, etc. when working with a word processor or a typewriter, and, more particularly, relates to a portable and retractable book-reading stand able to house all related elements in one package when not in use.

Up to the present, as shown in FIG. 10 and FIG. 11, there was a book-reading stand 40 laid open as Utility Model No. Heisei 2 (1990)-82927. This book-reading stand 40 is supported with legs, 42, 42 under a plate board 41 and a foldable U-shaped stay 44 attached to the back surface of said plate board 41. A latch plate 43 for supporting said stay 44 is also foldably connected to said plate board 41. Each end of a pair of hook-nosed holders 46, 46 is inserted in a pair of retaining rings 45, 45 fixed to the back surface of said plate board 41 so as being rotatable to the right and left with moderate clearance. The other end of each of said hook-nosed holders 45, 45 is rotatable on the top surface of said plate board 41, and presses down the opened pages of a book 47 placed on said plate board 41. An extensible plate 48 installed on the upper side of said plate board 41 is connected to a slider 49. Said slider 49 is movable up and down in a guide 50 fixed on the rear surface of said plate board 41 and is stably locked in the preferred position with a set screw 51. A clip 52 installed on said extensible plate 48 clamps the document to be read. A large-sized document may be clipped on said extensible plate 48 by extending said plate 48 upwards.

Furthermore, a pair of U-shaped extensible paper-holding wings made of metal bar 53, 53 each having a guide plate 54 are placed on both sides of said plate board 41. Each guide plate 54, 54 is slidably supported with a guide 55, 55 fixed on the rear surface of said plate board 41 so as to be slidable with moderate clearance, then said guide plates 53, 53 are able to be extended horizontally according to the size of the document to be held.

Also, a transparent plastic cursor 56 slidably installed on the right-hand wing 53 with moderate clearance is slidable so as to have a black centre line set on the column of the document to be read.

Referring to this book-reading stand, as above-mentioned, said plate board 41 is built in a fixed size to accommodate a standard-size document, which is not handy for carrying. Accordingly, when used outside of the specifically laid-out working place, it is very hard to do work while reading the document held on a space-limited working desk.

Consequently, this conventional book-reading stand has drawbacks requiring many component parts because of its complex construction, which further incurs high production costs.

In considering the above-mentioned problems, this invention was accomplished to attain the objective of providing a portable and retractable book-reading stand which is handy for carrying saves installation space, and has low production costs.

SUMMARY OF THE INVENTION

This portable and retractable book-reading stand according to this invention is characterized by having:

a case having a bottom plate and a covering body rotatably hinged to said bottom plate and enabling said bottom plate to be stably held on said covering body, in the specified inclined position in relation to the horizontal plane, by turning said covering body around said hinges;

an expandable supporting member being retractable in said case when out of use and expandable along said inclined bottom plate for holding a book, a document or others to be read; and a clip mounted on the upper portion of said supporting member.

Owing to the above-mentioned construction, by rotating said cover plate and setting said cover plate in contact with said bottom plate, said cover plate is held on said bottom plate at said specified inclined angle. The inclined angle of said bottom plate is determined with the connecting position and the contacting position between said cover plate and said bottom plate. In succession, by expanding said supporting member installed on said bottom plate, said supporting member shall be expanded upwardly along said inclined bottom plate.

By holding or clipping a book or a document on said expanded supporting member, it becomes possible to easily read said book or document.

After said book or document is read over, by retracting said supporting member, and by housing it in said case, and by shutting said cover plate, this book-reading stand is compactly packed in said case.

DETAILED DESCRIPTION OF THE INVENTION

As follows, embodiments according to this invention are described in detail with reference to the drawings.

The first embodiment adopting a plural of rotatable and foldable supporting members as a support assembly is shown in FIG. 1 to FIG. 6.

Figure 1:
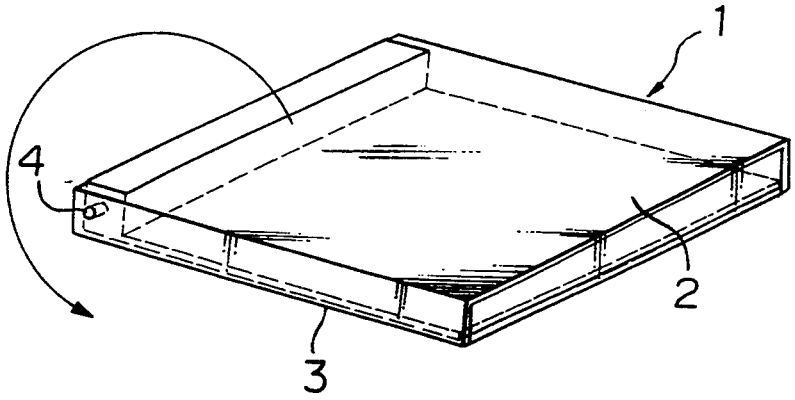
FIG. 1 is a perspective view of a portable book-reading stand when out of use, constructed in accordance with this invention.
Figure 2:
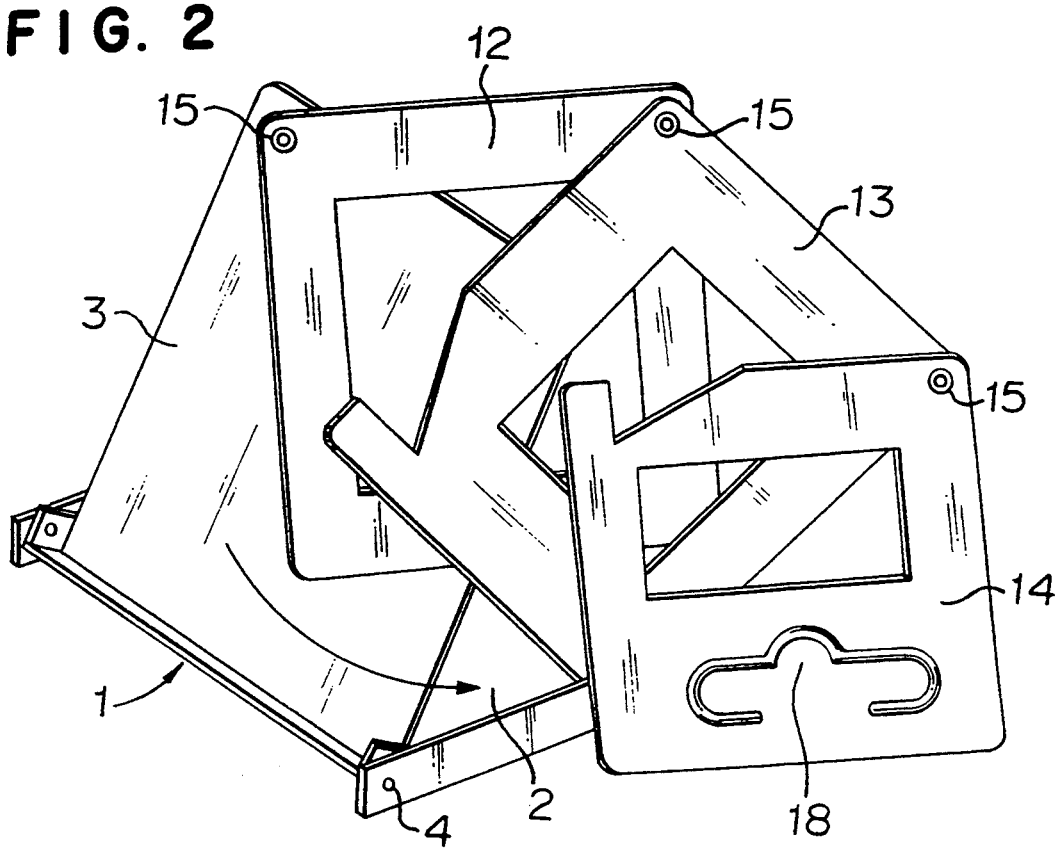
FIG. 2 shows a perspective view of the first embodiment of this invention, in preparation for use.

In FIG. 1 and FIG. 2, numeral 1 identifies a plastic case having the same size and same construction as a 3.5-inch mini floppy disk case, numeral 2 identifies a covering body of said case 1, numeral 3 identifies a bottom plate thereof, and numeral 4 shows a pair of hinges for connecting said covering body and bottom plate. By rotating said covering body 2 around said hinges 4, 4 counterclockwise until said covering body 2 is stopped, said bottom plate 3 is stably held in the inclined position suitable for reading the book or document placed or held on said bottom plate and said expanded support assembly. The inclined angle of said bottom plate 3 is determined by the contacting position of said bottom plate 3 and covering body 2.

Figure 3:
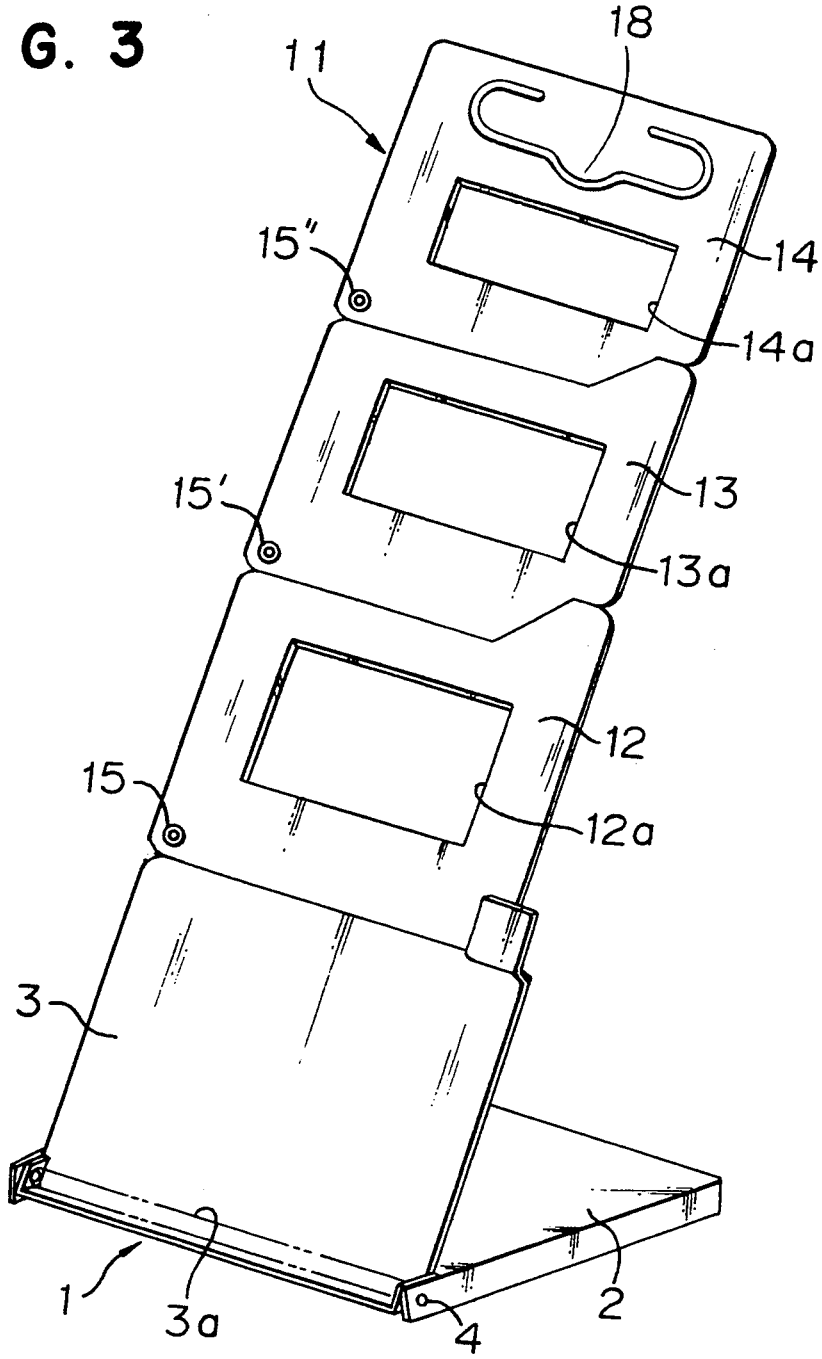
FIG. 3 shows a perspective view of the first embodiment of this invention, in a usable condition.
Figure 4:
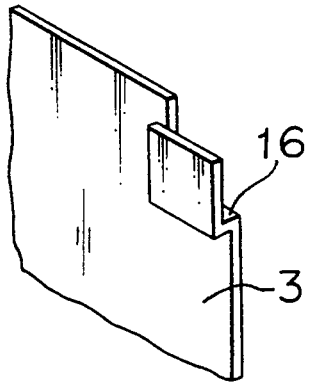
FIG. 4 shows an enlarged perspective view of the upper part of the bottom plate in the first embodiment of this invention.
Figure 5:
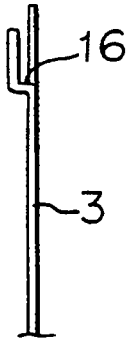
FIG. 5 shows a side view of FIG. 4.

A support assembly 11 is composed of 3 supporting members 12, 13, and 14 as shown in FIG. 2. Each supporting member is made of plastic and generally square-shaped and finished in the same size. These supporting members 12, 13, 14 are rotated, connected in series, and at last build up said one-pieced support assembly 11 as shown in FIG. 3.

Referring to said lowest support member 12, the left upper corner thereof (in the position piled on said bottom plate 3) is rotatably hooked up with the left upper corner of said bottom plate 3 with a hook 15. By turning said member 12 counterclockwise only 90 degrees, and letting it engage with a cave 16 positioned in the right upper corner of said bottom plate 3 shown in FIG. 4 and FIG. 5, said support member 12 is extended from said bottom plate 3.

Figure 6:
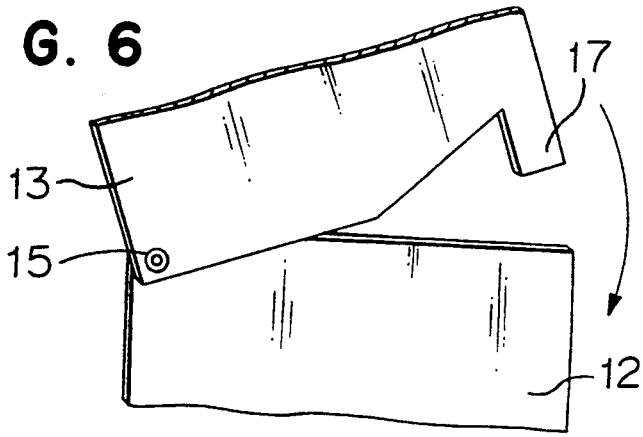
FIG. 6 shows a partial front view explaining the engaging action of each supporting plate of the first embodiment of this invention.

Referring to said middle supporting member 13, the left upper corner thereof (in the position piled on said bottom plate 3) is rotatably hooked up with the left upper corner of said supporting member 12 with a hook 15', and an upper edge is triangularly cut off for shaping an engaging portion 17 to said member 12 (see FIG. 2). By turning said member 13 counterclockwise only 90 degrees, and letting said engaging portion 17 insert into said member 12, said member 13 is extended from said member 12 as shown in FIG. 6.

Furthermore, referring to said upper supporting member 14, the right lower corner thereof (in the position piled on said bottom plate 3) is rotatably hooked up with the right lower corner of said supporting member 13 with a hook 15', and a right side edge is triangularly cut off for shaping an engaging portion to said member 13 the same as member 13. By turning said member 14 counterclockwise only 90 degrees, and letting said engaging portion insert into said member 13, said member 14 is extended from said member 13 as shown in FIG. 6.

Holes **12*a*, 13*a* and 14*a* are punched into said supporting members 12, 13 and 14 to reduce their weights, and in an upper portion of said supporting member 14, a curved slit forming a clip 18** is punched.

By the above-mentioned manipulation, said support assembly 11 comprised of said supporting members 12, 13 and 14 is expanded upwardly along the inclined surface of said bottom plate 3 so to be able to hold the document clipped with said clip 18 as shown in FIG. 3.

When retracting said support assembly 11, by performing the reverse operation, all supporting members are retracted and piled on said bottom plate 3, and by rotating said covering body 2, this book-reading stand is packed in said case 1.

In the above-mentioned first embodiment of this invention, said retracted support assembly 11 is hooked to said bottom plate 3 through said supporting member 12, but it may be possible to separate said assembly 11 from said case 1. In this case, said elongated support assembly is inserted and supported by a receiving pit **3*a* installed on the bottom of said bottom plate 3. Said receiving pit 3*a* is shown with the double dotted line in FIG. 3**.

Furthermore, this portable and retractable book-reading stand according to this first embodiment of this invention is applicable not only to a book-reading stand but also to a music book stand, a menu stand or a memo clip.

Figure 7:
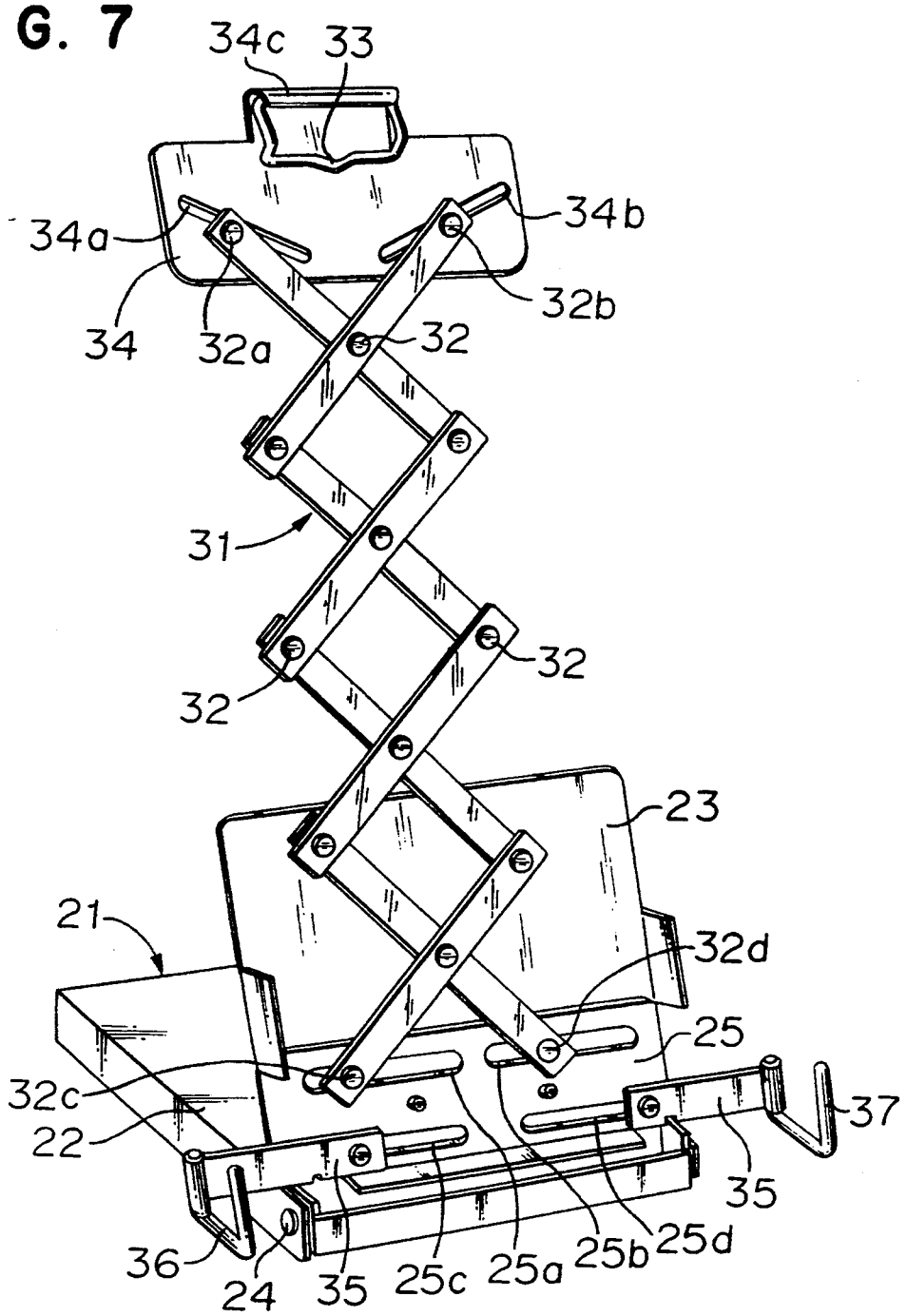
FIG. 7 shows a perspective view of a second embodiment of this invention, in a usable condition.
Figure 8:
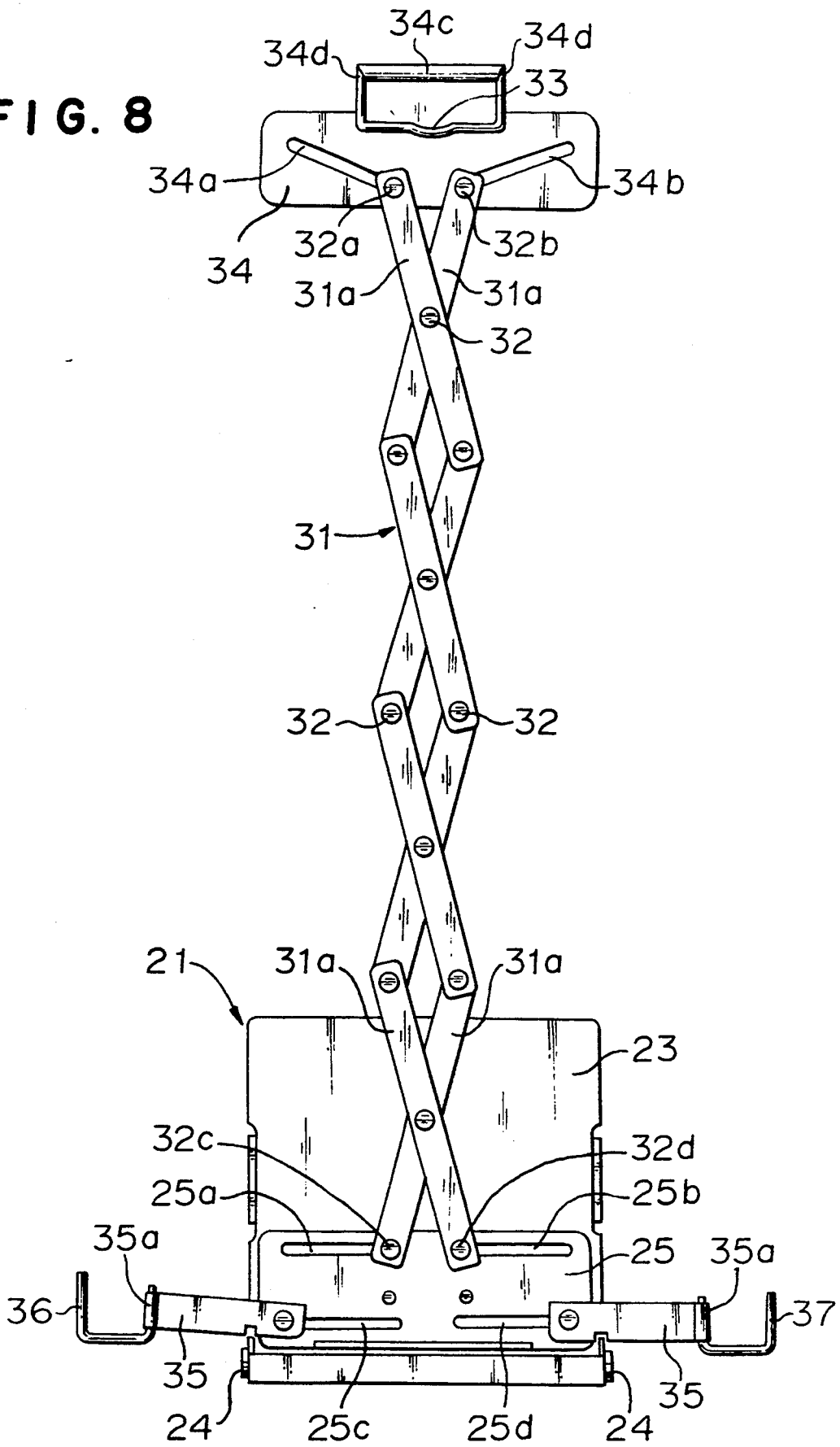
FIG. 8 shows a front view of a second embodiment of this invention when elongated to the highest position.
Figure 9:
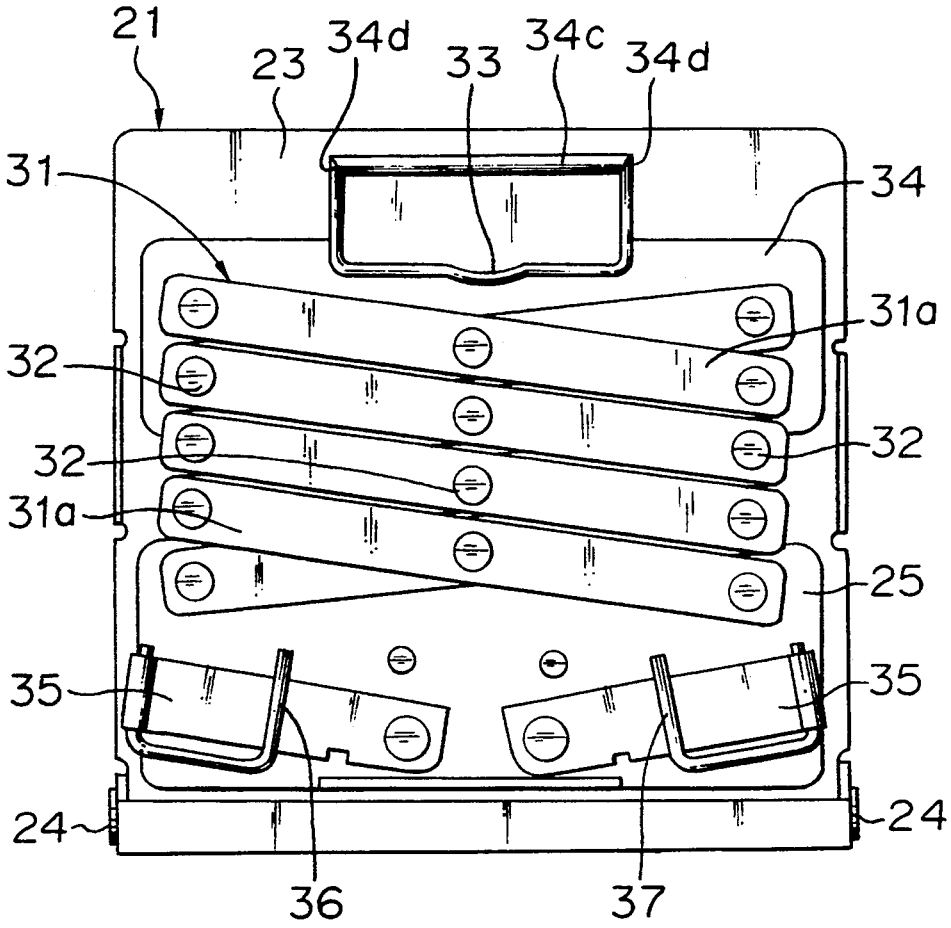
FIG. 9 shows a front view of the second embodiment of this invention when out of use.
Figure 10:
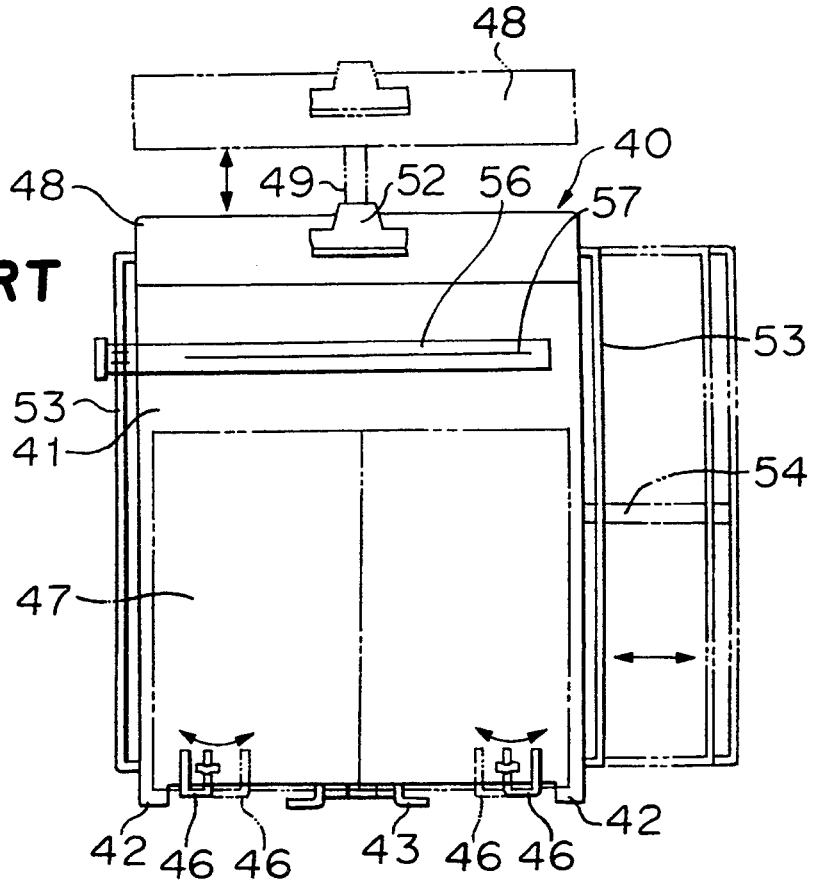
FIG. 10 PRIOR ART
FIG. 10 shows a front view of a conventional book-reading stand cited as prior art.
Figure 11:
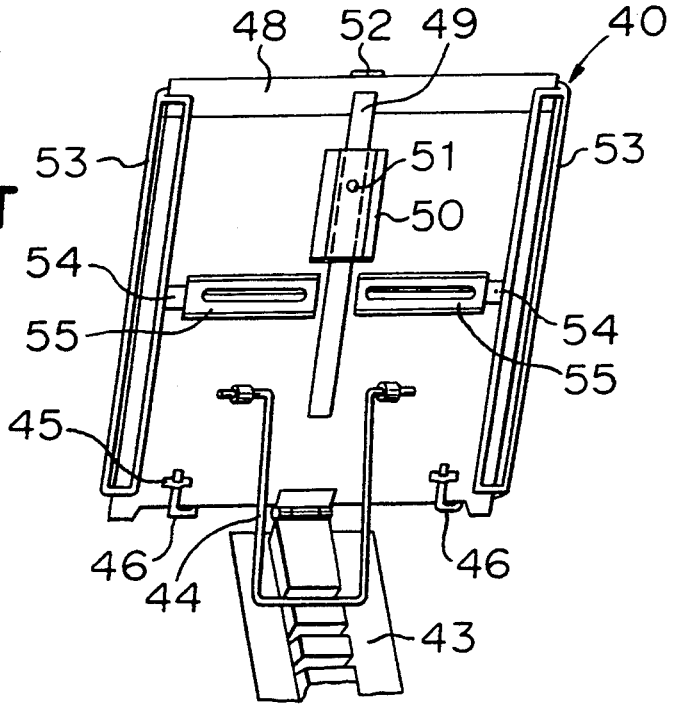
FIG. 11 PRIOR ART
FIG. 11 shows a back side perspective view of the conventional book-reading stand shown in FIG. 10.

Next, the second embodiment of this invention applying a link mechanism as said support assembly instead of a plural of sheet-like supporting members, is described in detail in reference to FIG. 7–FIG. 9.

In FIG. 7 to FIG. 9, numeral 21 identifies a case made of stainless steel having generally the same size as a 3.5-inch micro floppy disc case, numeral 22 shows a covering body of said case 21, and numeral 23 identifies a bottom plate of said case 21, connected rotatably to said covering body with hinges 24.

By rotating said covering body 22 counterclockwise around said hinges 24, 24 until said body 22 is stopped, said bottom plate 23 is stably held in an inclined position suitable for reading a book or document placed or held on said inclined bottom plate 23 and said expanded support assembly. The inclined angle of said bottom plate 23 is determined by the contacting position of said bottom plate 23 and covering body 22.

In this embodiment, a plural of link members, such as scissor-like links made of stainless steel **31*a* composing said link mechanism 31 are each rotatably caulked by a plural of link pins 32 with adequate frictional resistance, as shown in FIG. 7**.

A pair of lowermost link members are slidably installed in a pair of horizontal long grooves **25*c*, 25*d* engraved in a plate bracket 25 securely attached on said bottom plate 23 through a pair of sliding pins 32*c*, 32**.

Also a pair of uppermost link members are slidably installed in a pair of inclined long grooves **34*a*, 34*b* engraved in an upper plate member 34 through a pair of sliding pins 32*a*, 32*b*. A clip 33 is attached on an extruded portion of said upper plate member 34**.

According to the above-mentioned construction, by pulling said upper plate member 34 upwards, said link mechanism 31 upwardly expands along said inclined bottom plate 23, as shown in FIG. 7. In this case, owing to the above-mentioned adequate frictional resistance between said link element **31*a* and link pin 32, said link mechanism 31 is able to hold its expanded condition, and it is then possible to hold stably a book or a document clamped in said clip 33 on said link mechanism 31. FIG. 8** shows this embodiment expanded to the highest position.

After reading work is completed, by pushing said upper plate member downwardly, said link mechanism 31 contracts to be housed in said case 21 as shown in FIG. 9.

In this embodiment, said clip 33 made of a single bent steel rod is installed so that both its ends are inserted into a bearing journal **34*c* bent around said upper plate member 34, and as both ends 34*d*, 34*d* of said bearing journal 34*c* are obliquely cut downwardly as shown in FIG. 8 and FIG. 9, then said clip 33 is usually energized to press down the document to be clipped. Also, as mentioned above, said uppermost link elements slide in a pair of inclined long grooves 34*a*, 34*b* and the central surface of said upper plate member 34** is available for clipping a document without obstruction by said link elements.

Furthermore, in this embodiment, a pair of horizontal long grooves **25*c*, 25*d* are engraved in said plate bracket 25, and a pair of hooks 36, 37 are slidably and rotatably installed on a pair of plate members 35, 35 moving towards the left and right through slide pins (numerals not identified) inserted in said long grooves 25***c*, 25*d*. Accordingly, by expanding said plate members 35, 35 towards the left and right in accordance with the size of the book or document to be held, and by pressing with said hooks 36, 37, it becomes possible to hold them stably.

When said hooks 36, 37 are out of use, after being folded inwardly or moving same with said hooks folded thereagainst at a right angle or orthogonally to the link mechanism 31, by retracting said plate members 35, 35 inwardly, said hooks 36, 37 and said plate members 35, 35 may be housed in said case 21 as shown in FIG. 9. Also, as said hooks 36, 37 inserted in bearing journals of said plate members 35, 35 are equipped with E rings, said hooks 36, 37 are able to rotate without dropping from said journals (E rings are not shown).

In this secondary embodiment of this invention, as described above, it is possible to maintain a stable working condition without adding any extra stabilizing devices for holding said link mechanism in the preferred position, and all the elements including said link mechanism 31, said clip 33 and said hooks 36, 37 are completely housed in said case 21.

In conclusion, this book-reading stand according to this invention allows said case to be built compactly and be easy for carrying, as said supporting assembly for holding documents is installed in said bottom plate and housed in said case when out of use. Furthermore, this book-reading stand is easily installed in restricted spaces because the required installation space is minimum, and the stand can be provided at a low cost owing to its simple construction and the small number of required parts.

Although in these embodiments, the cases are limited to the size of a 3.5-inch micro floppy disc case, it is possible to apply any sized case required as long as it is portable and retractable, and the material used in this invention is not restricted to plastic or stainless steel as described in these embodiments as long as it can bear the required load.

What I claim is:

1. A portable and retractable book-reading stand for holding a book or document to be read when said stand is in use, comprising:

a case having a bottom plate, a covering body and a hinge rotatably connecting said covering body to said bottom plate, and said bottom plate being adapted to be positioned on said covering body at a specified inclined angle by rotating said bottom plate around said hinge means until said bottom plate stops;

a plate-like bracket fixed on said bottom plate;

a supporting assembly having an upper portion, and further comprising a plurality of scissor-like links having dual upper and lower ends and fastening means connecting said lower ends to said plate-like bracket, said scissor-like links being expandable along said inclined bottom plate for holding a document to be read in an expanded condition, and being contractible to a size so as to be housed in said case in a retracted condition;

a clip comprising a rod installed on the upper portion of said supporting assembly along with opposite upper ends of said plurality of links, and said clip being adapted for bearing down on the top of a book or document to be held against said plurality of links; and a pair of hooks provided on said plate-like bracket being rotatable and movable sideways; whereby when said clip and said pair of hooks are folded flat against said supporting assembly, and said supporting assembly is retracted, said stand is capable of being housed in said case as a small compact unit of about the size of a micro floppy disc.

2. A portable and retractable book-reading stand recited in claim 1, wherein said case is of the size same as a 3.5-inch mini floppy disk case.

3. A portable and retractable book-reading stand recited in claim 1, wherein said pair of hooks on said plate-like bracket restrain or support the expanded width of the book or document to be read.

4. A portable and retractable book-reading stand according to claim 1, wherein said case is made of plastic.

5. A portable and retractable book-reading stand according to claim 1, wherein said case is made of a metal.

6. A portable and retractable book-reading stand according to claim 1, wherein said supporting assembly is upwardly expandable so as to support a book or document of predetermined height.

7. A portable and retractable book-reading stand according to claim 1, wherein said pair of hooks are adapted to slide to the left and right.

8. A portable and retractable book-reading stand according to claim 7, wherein said pair of hooks move at a right angle or orthogonally to the upwardly expandable supporting assembly so that a wide book or document can be held by means of said pair of hooks with said book or document inclined against said bottom plate.

9. A portable and retractable book-reading stand according to claim 1, wherein said case acts as a limit stop for stopping the rotation of said bottom plate at said specified inclined angle.

* * * * *

UNITED STATES PATENT AND TRADEMARK OFFICE

CERTIFICATE OF CORRECTION

PATENT NO. : 5,393,029

DATED : Feb. 28, 1995

INVENTOR(S) : Hajime Senko

It is certified that error appears in the above-identified patent and that said Letters Patent is hereby corrected as shown below:

On the Title page, item [30];

Foreign Application Priority Data

Nov. 6, 1992 [JP] Japan.....4-083154
Jul.14, 1992 [JP] Japan.....4-055267
Dec. 7, 1991 [JP] Japan.....3-108972

Signed and Sealed this

Fifteenth Day of August, 1995

Bruce Lehman

*Attest:*

BRUCE LEHMAN

*Attesting Officer*

*Commissioner of Patents and Trademarks*